US008232747B2

(12) United States Patent
Crewson et al.

(10) Patent No.: US 8,232,747 B2
(45) Date of Patent: Jul. 31, 2012

(54) PARTICLE ACCELERATOR AND MAGNETIC CORE ARRANGEMENT FOR A PARTICLE ACCELERATOR

(75) Inventors: Walter Frederick John Crewson, Munsonville, NH (US); Mark H. Kaltenborn, Ridgefield, CT (US)

(73) Assignee: ScandiNova Systems AB, Uppsala (SE)

( * ) Notice: Subject to any disclaimer, the term of this patent is extended or adjusted under 35 U.S.C. 154(b) by 493 days.

(21) Appl. No.: 12/490,715

(22) Filed: Jun. 24, 2009

(65) Prior Publication Data

US 2010/0327785 A1 Dec. 30, 2010

(51) Int. Cl.
*H05H 9/00* (2006.01)

(52) U.S. Cl. ..... 315/505; 315/500

(58) Field of Classification Search ..... 315/500–507
See application file for complete search history.

(56) References Cited

U.S. PATENT DOCUMENTS

| | | | | |
|---|---|---|---|---|
| 3,373,325 | A | 3/1968 | Sipek et al. | |
| 5,138,393 | A | 8/1992 | Okamura et al. | |
| 7,830,040 | B2 * | 11/2010 | McDonald | 307/106 |
| 2004/0065842 | A1 | 4/2004 | Parr et al. | |
| 2007/1456916 | | 6/2007 | Caporaso et al. | |
| 2008/0284276 | A1 | 11/2008 | McDonald | |
| 2008/0315801 | A1 | 12/2008 | Caporaso et al. | |

FOREIGN PATENT DOCUMENTS

| | | | |
|---|---|---|---|
| JP | 2004215473 | A | 7/2004 |
| SU | 322136 | A | 10/1974 |

OTHER PUBLICATIONS

International Search Report in Corresponding Application No. PCT/SE2010/050620 dated Sep. 28, 2010.
Beal, J.W. et al., "The Aston Linear Accelerator", Nuclear Science, Jun. 1969, pp. 294-298, vol. 16, No. 3.
Parker, A., "Solid-State Technology Meets Collider Challenge", S&TR, Sep. 2004, pp. 22-24.

* cited by examiner

*Primary Examiner* — Don Le
(74) *Attorney, Agent, or Firm* — Young & Thompson

(57) ABSTRACT

A particle accelerator (100) comprises a power supply arrangement (110), a plurality of solid-state switched drive sections (120), a plurality of magnetic core sections (130) and a switch control module (140). The drive sections (120) are connected to the power supply arrangement (110) for receiving electrical power therefrom, and each drive section comprises a solid-state switch, electronically controllable at turn-on and turn-off, for selectively providing a drive pulse at an output of the drive section. The magnetic core sections (130) are symmetrically arranged along a central beam axis, and each magnetic core of the sections is coupled to a respective drive section (120) through an electrical winding connected to the output of the drive section. The switch control module (140) is connected to the drive sections (120) for providing control signals to control turn-on and turn-off of the solid state switches to selectively drive magnetic cores to induce an electric field for accelerating the beam of charged particles along the beam axis.

19 Claims, 7 Drawing Sheets

PARTICLE ACCELERATOR AND MAGNETIC CORE ARRANGEMENT FOR A PARTICLE ACCELERATOR

TECHNICAL FIELD

The present invention generally relates to particle accelerator technology, and more particularly to a particle accelerator and a magnetic core arrangement for such an accelerator.

BACKGROUND

Industrial and medical particle accelerators such as electron beam accelerators enjoy an annual worldwide market of approximately many millions of dollars. They are used in applications ranging from product sterilization of e.g. medical instruments and food containers, to material modification such as tire vulcanization, printing ink curing, plastics cross-linking and paper manufacture, to electron-beam welding of thick-section plates in e.g. automobile manufacture and to medical applications including radiation therapy. Other applications include chemical-free municipal water sterilization and boiler flue gas treatment to remove sulfur and nitrogen oxides from the effluent gases and create fertilizer in the process. Linear particle accelerators in particular may also be used as an injector into a higher energy synchrotron at a dedicated experimental particle physics laboratory.

There are generally three major types of particle accelerators:

- Electrostatic accelerators in which the particles are accelerated by the electric field between two different fixed potentials. Examples include the Van der Graff, Pelletron and Tandem accelerators.
- Radio-frequency (RF) based accelerators in which the electric field component of radio waves accelerates particles inside a partially closed conducting cavity acting as a RF resonator.
- Induction-based accelerators in which pulsed voltage is applied around magnetic cores to thereby induce an electric field for accelerating the particle beam.

Electrostatic accelerators such as the classical Van der Graff accelerators have been used for years, and are still in use in e.g. experimental particle and/or ion beam installations.

Present RF-based accelerator technology normally uses a variety of high voltage generators which are enclosed in pressurized gas tanks. The two dominant designs are based on the Dynamitron (Radiation Dynamics Inc, RDI) and the Insulated-Core Transformer or ICT (Fujitsu of Japan). The Dynamitron is powered by ultrasonic radio frequency oscillations from a vacuum tube generator. The ICT is powered by A.C. from the conventional power line. Another high power machine, the Rhodotron, is also commercially available on the market. However, all of these machines suffer from one or more of the disadvantages of using high-voltage generators, dangerous and heavy high pressure tanks, and potentially toxic and expensive gases.

In the early 1960's a so-called Linear Magnetic Induction (LMI) Accelerator was designed by Nicholas Christofilos of the U.S. Government's Lawrence Livermore National Laboratory (LLNL). At that time, the laboratory was named "Lawrence Radiation Laboratory" or LRL. This accelerator design was based on the use of a large number of toroidal (doughnut-shaped) magnetic cores, each core being driven by a high voltage pulse generator at several tens of kilovolts (kV) (using a spark-gap switch and a pulse-forming network or PFN) to generate an accelerating potential of several hundred kV to several megavolts (MV) to accelerate a high-current beam of charged particles.

A key feature of this type of accelerator is that it, like all Linear Accelerators (LINACs), has an outer surface which is at ground potential. The voltages which drive the individual cores all appear to add "in series" down the central axis, but do not appear anywhere else. This means the accelerator does not radiate electromagnetic energy to the "outside world" and is easy to install in a laboratory as it needs no insulation from its surroundings. An 800 kV LMI accelerator, the ASTRON linear accelerator, was built at LLNL in the late 1960s [1], and was used for electron-beam acceleration in fusion experiments. A larger LMI machine (FXR, Flash X-Ray) was built in the 1970s, and used for accelerating an electron beam pulse into an x-ray conversion target. The FXR accelerator was used for freeze-frame radiography of explosions.

The basic idea of this so-called Linear Magnetic Induction (LMI) Accelerator is schematically illustrated in FIG. 1. The LMI accelerator of FIG. 1 is built around a set of toroidal magnetic cores arranged so their central holes surround a straight line, the so-called central beam axis, along which the particle beam is to be accelerated. Each magnetic core has a high-voltage drive system comprising a high-voltage pulse Forming Network (PFN) and a high voltage switch such as a spark gap switch. For simplicity, only one drive section is shown in FIG. 1.

The high-voltage switch is typically a plasma or ionized-gas switch such as a hydrogen thyratron tube that can only be turned on but not turned off. Instead, the PFN is required to create the pulse and deliver power in the form of a rectangular pulse with a relatively fast rise and fall-time as compared to the pulse width. The PFN normally discharges in a traveling-wave manner, with an electrical pulse wave traveling from the switched end to the "open circuited" end, reflecting from this open circuit and returning toward the switched end, extracting energy from the energy storage capacitors of the PFN network as it travels and "feeding" the energy into the core section. The pulse ends when the traveling wave has traversed the PFN structure in both directions and all the stored energy has been extracted from the network. The PFN voltage before switching is V, and the voltage applied to the primary side of the pulse transformer is V/2 or a bit less. If a component in the PFN fails, it is necessary to re-tune the PFN for optimal pulse shape after the component is replaced. This is laborious and dangerous work, as it must be done with high voltage applied to the PFN. Besides, if a different pulse width is needed, it is necessary to replace and/or re-tune the entire PFN structure. The high-voltage PFNs and switches also suffer from disadvantages with respect to reliability and safety.

Several companies have built accelerators based on the early ASTRON design. The designs used to drive the accelerators are based on spark gap or thyratron switches in combination with the cumbersome high-voltage PFN networks, and so are not cost-competitive with the RF-based designs such as the Dynamitron and the ICT.

There are also modern designs which are based on solid-state modulator systems that convert AC line power into DC power pulses, which in turn are transformed into radio frequency (RF) pulses that "kick" the particles up to the required energy levels [2].

Other examples of solid-state modulators that can be used for driving RF-based systems are disclosed in [3-5].

LLNL has also presented compact dielectric wall accelerators (DWA) and pulse-forming lines that operate at high gradients to feed an accelerating pulse down an insulating wall, with a charged particle generator integrated on the accelerator to enable compact unitary actuation [6]. Other examples based on DWA and/or Blumlein accelerator technology are described in [7-8].

There is a general need for improvements in particle accelerator design with respect to one or more of the issues of cost-effectiveness, reliability, on-line availability, size, energy-consumption and safety.

SUMMARY

The present invention overcomes these and other drawbacks of the prior art arrangements.

It is a general object to provide an improved induction-based particle accelerator.

It is also an object to provide an improved magnetic core arrangement for a particle accelerator.

In a first aspect, a basic idea is to build an induction-based particle accelerator for accelerating a beam of charged particles along a central beam axis. The particle accelerator basically comprises a power supply arrangement, a plurality of solid-state switched drive sections, a plurality of magnetic core sections and a switch control module for controlling the solid-state switches of the drive sections. The solid-state switched drive sections are connected to the power supply arrangement for receiving electrical power therefrom, and each solid-state switched drive section comprises a solid-state switch, electronically controllable at turn-on and turn-off, for selectively providing a drive pulse at an output of the solid-state switched drive section. The magnetic core sections are symmetrically arranged along the central beam axis, and each magnetic core of the magnetic core sections is coupled to a respective solid-state switched drive section through an electrical winding that is connected to the output of the solid-state switched drive section. The switch control module is connected to the solid-state switched drive sections for providing control signals to control turn-on and turn-off of the solid state switches to selectively drive cores of the magnetic core sections in order to induce an electric field for accelerating the beam of charged particles along the central beam axis.

In this way, a low-cost induction-based accelerator can be obtained with a high degree of reliability, on-line availability and safety (low-voltage drive). The traditional high-voltage drive systems of induction-based accelerators with thyrathrons or spark gap switches can be completely eliminated. For example, to obtain an accelerating structure of 100 kV, 100 magnetic cores can be used, where each core is driven by a 1 kV solid-state switched drive pulse. The new conceptual accelerator design also means that no dangerous and heavy high pressure tanks are required, and no potentially toxic and expensive gases.

In a second aspect, a basic idea is to provide a magnetic core arrangement for a particle accelerator. The magnetic core arrangement basically comprises a plurality of magnetic core sections arranged along a central axis. Each of a number of the magnetic core sections comprises at least two magnetic cores, a first one of the magnetic cores, referred to as an outer magnetic core, being arranged radially outward from the central axis with respect to a second one of the magnetic cores, referred to as an inner magnetic core. This concept can of course be expanded to several cores per accelerating section.

By "nesting" additional cores radially outward from the center, the accelerating E field (Volts/meter of machine length) is raised significantly above a traditional single-core design.

This gives the freedom to trade machine diameter against machine length. This in turn allows a much more compact machine, as the machine length can be considerably shortened in comparison to existing designs.

Other advantages offered by the invention will be appreciated when reading the below description of embodiments of the invention.

BRIEF DESCRIPTION OF THE DRAWINGS

The invention, together with further objects and advantages thereof, will be best understood by reference to the following description taken together with the accompanying drawings, in which.

DETAILED DESCRIPTION OF EMBODIMENTS

Figure 1:
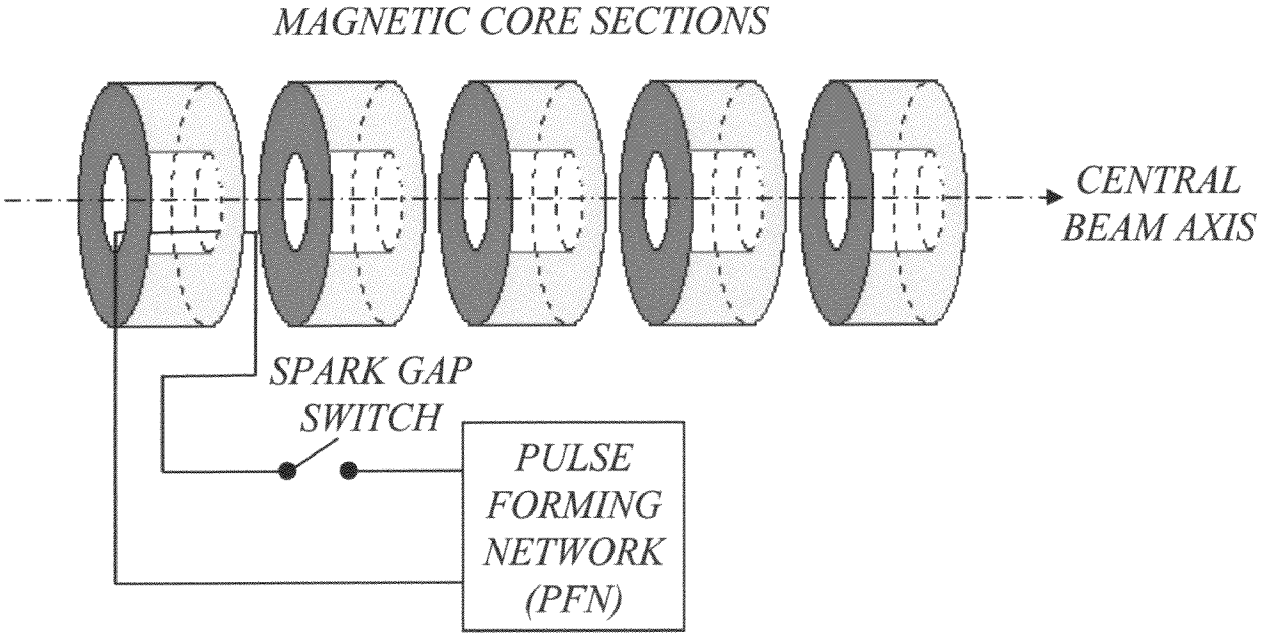
FIG. 1 (Prior art)
FIG. 1 is a schematic diagram illustrating the basic concept of a traditional Linear Magnetic Induction (LMI) Accelerator.

Throughout the drawings, the same reference characters will be used for corresponding or similar elements.

Figure 2:
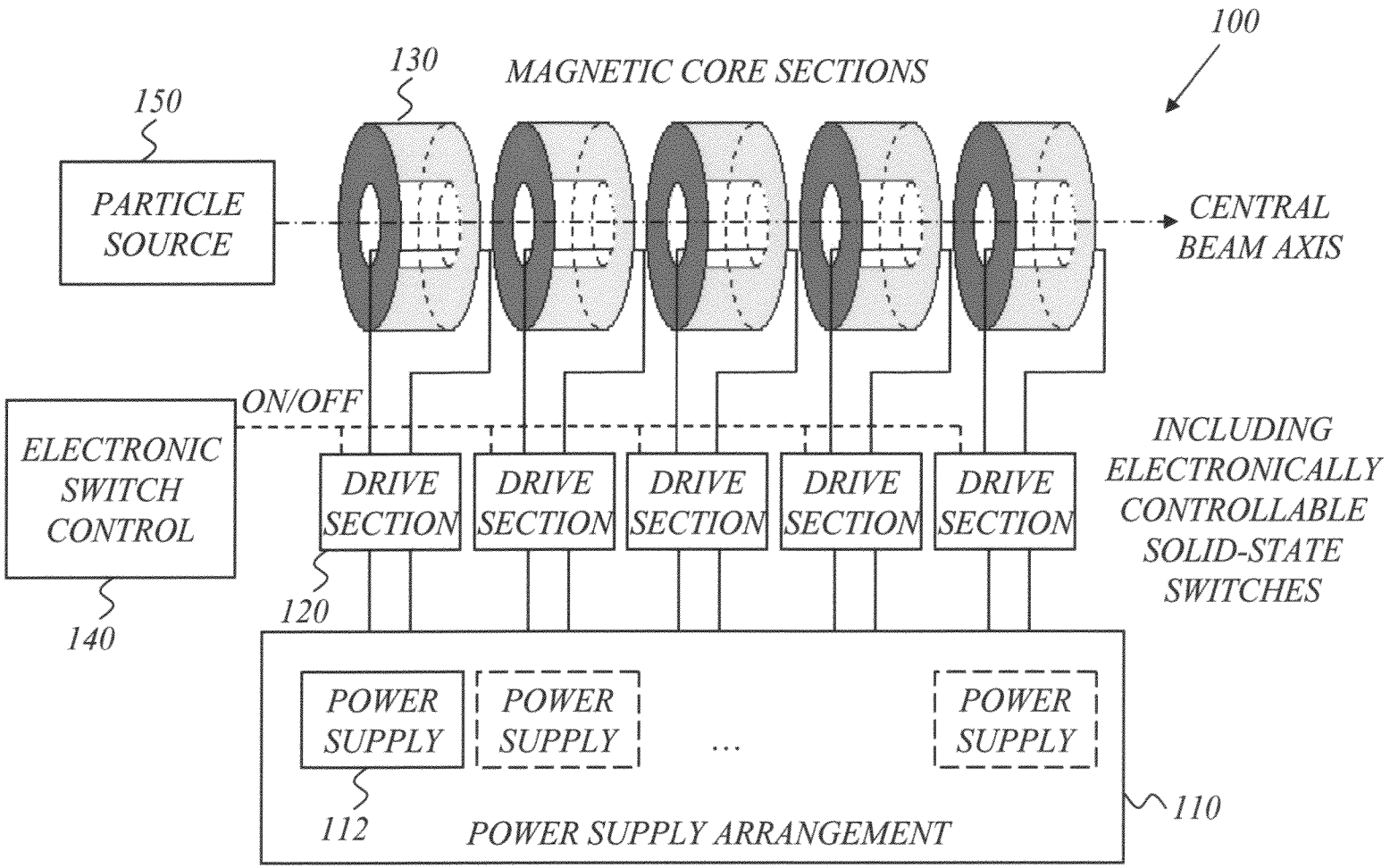
FIG. 2 is a schematic diagram illustrating a basic concept of a novel induction-based particle accelerator according to an exemplary embodiment.

FIG. 2 is a schematic diagram illustrating a basic concept of a novel induction-based particle accelerator according to an exemplary embodiment.

For simplicity, the particle accelerator is here illustrated as a linear accelerator (LINAC). The LINAC is a preferred type of accelerator, but the invention is not limited thereto.

The accelerator 100 basically comprises a power supply arrangement 110 having one or more power supply units 112, a plurality of solid-state switched drive sections 120, a plurality of magnetic core sections 130, and electronic switch control module 140 and a particle source 150.

The power supply arrangement 110 may have a connection arrangement for connection of a power supply unit 112 to more than one, possibly all, of the solid-state switched drive sections 120. For example, this means that the power supply arrangement 110 may have a single power supply unit 112 for connection to each one of the solid-state switched drive sections 120. As an alternative, it is possible to have an arrangement where each drive section 120 has its own dedicated power supply unit 112.

Anyway, the solid-state switched drive sections 120 are connected to the power supply arrangement 110 for receiving electrical power therefrom. Each solid-state switched drive section 120 preferably comprises a solid-state switch, electronically controllable at turn-on and turn-off, for selectively providing a drive pulse at an output of the solid-state switched drive section 120.

The magnetic core sections 130, each having at least one toroidal magnetic core, are symmetrically arranged along the central beam axis, and each magnetic core is coupled to a respective one of the solid-state switched drive sections 120 through an electrical winding that is connected to the output of the solid-state switched drive section.

The switch control module 140 is connected to the solid-state switched drive sections 120 for providing control signals (ON/OFF) to control turn-on and turn-off of the solid state switches of the drive sections 120 to selectively drive the magnetic core sections 130 in order to induce an electric field for accelerating the beam of charged particles originating from the particle source 150 along the central beam axis of the overall accelerating structure of the magnetic core sections 130.

In this way, a low-cost induction-based accelerator can be obtained with a high degree of reliability, on-line availability and safety (low-voltage drive). The traditional high-voltage drive systems of induction-based accelerators with thyrathrons or spark gap switches can be completely eliminated.

For example, to obtain an accelerating structure of 100 kV, an exemplary number of 100 magnetic cores can be used, where each core is driven by a 1 kV solid-state switched drive pulse. The new conceptual accelerator design also means that no dangerous and heavy high pressure tanks are required, and no potentially toxic and expensive gases. Similarly, to realize 1 MV accelerator, a total of 1000 cores can be used, each driven at 1 kV, or 2000 cores driven at 500 volts.

The invention is particularly preferred for accelerating structures of voltages higher than 10 kV, and even more preferred over 100 kV, or for megavoltage accelerators.

The Astron accelerator [1] and all other "linear-induction" accelerators built to date use part of the design in that they accelerate the beam by surrounding the beam axis with a number of pulsed magnetic cores. However, that is where the similarity ends. All other linear-induction accelerators use high voltage drive systems with thyratrons or spark gap switches.

The novel accelerator design presented here opens a door to a new world of reliability, safety and low cost; both of manufacture and of ownership (minimum maintenance is required).

Figure 3:
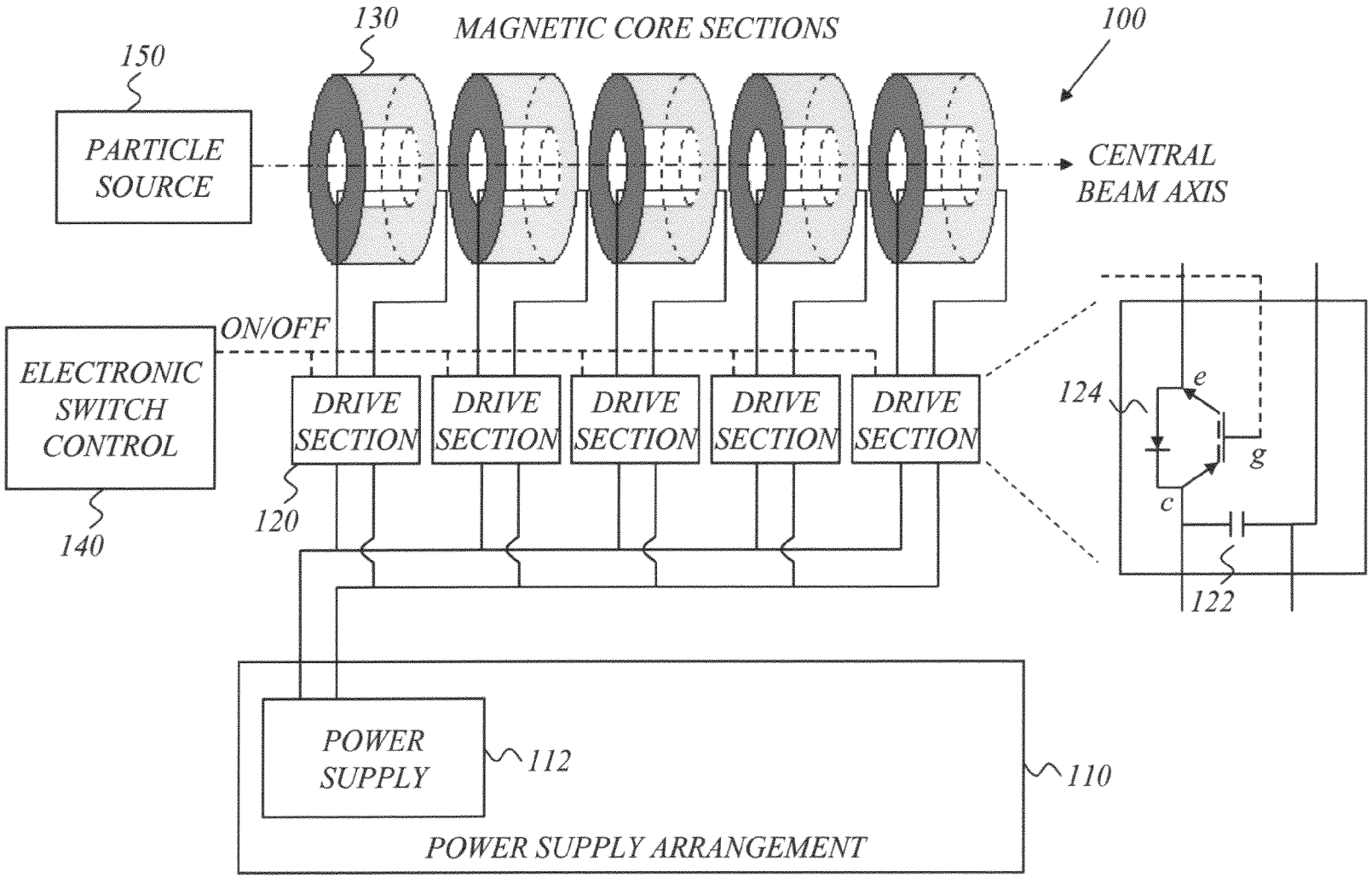
FIG. 3 is a schematic diagram illustrating a specific example of a particle accelerator implementation according to an exemplary embodiment.

FIG. 3 is a schematic diagram illustrating a specific example of a particle accelerator implementation according to an exemplary embodiment. In this particular example, each drive section 120 is based on an energy storage capacitor 122 and a solid-state switch 124 in the form of an Insulated-Gate Bipolar Transistor (IGBT). In this example, one and the same DC power supply unit 112 is connected to each one of the drive sections 120 for selectively charging the energy storage capacitor 122. By appropriate ON-OFF control from the switch control module 140, each IGBT switch 124 is operable to turn-on to start an output drive pulse by transferring capacitor energy from the capacitor 122 and operable to turn-off to terminate the output drive pulse. For example, the switched is turned on by supplying a suitable signal, such as a voltage control pulse, to the gate (g) electrode and the switch is turned off when the voltage control pulse ends.

Other examples of suitable solid-state switches include MosFets or IGTCs (Insulated Gate-Controlled Thyristors), which are controllable at both turn-on and turn-off.

Figure 4:
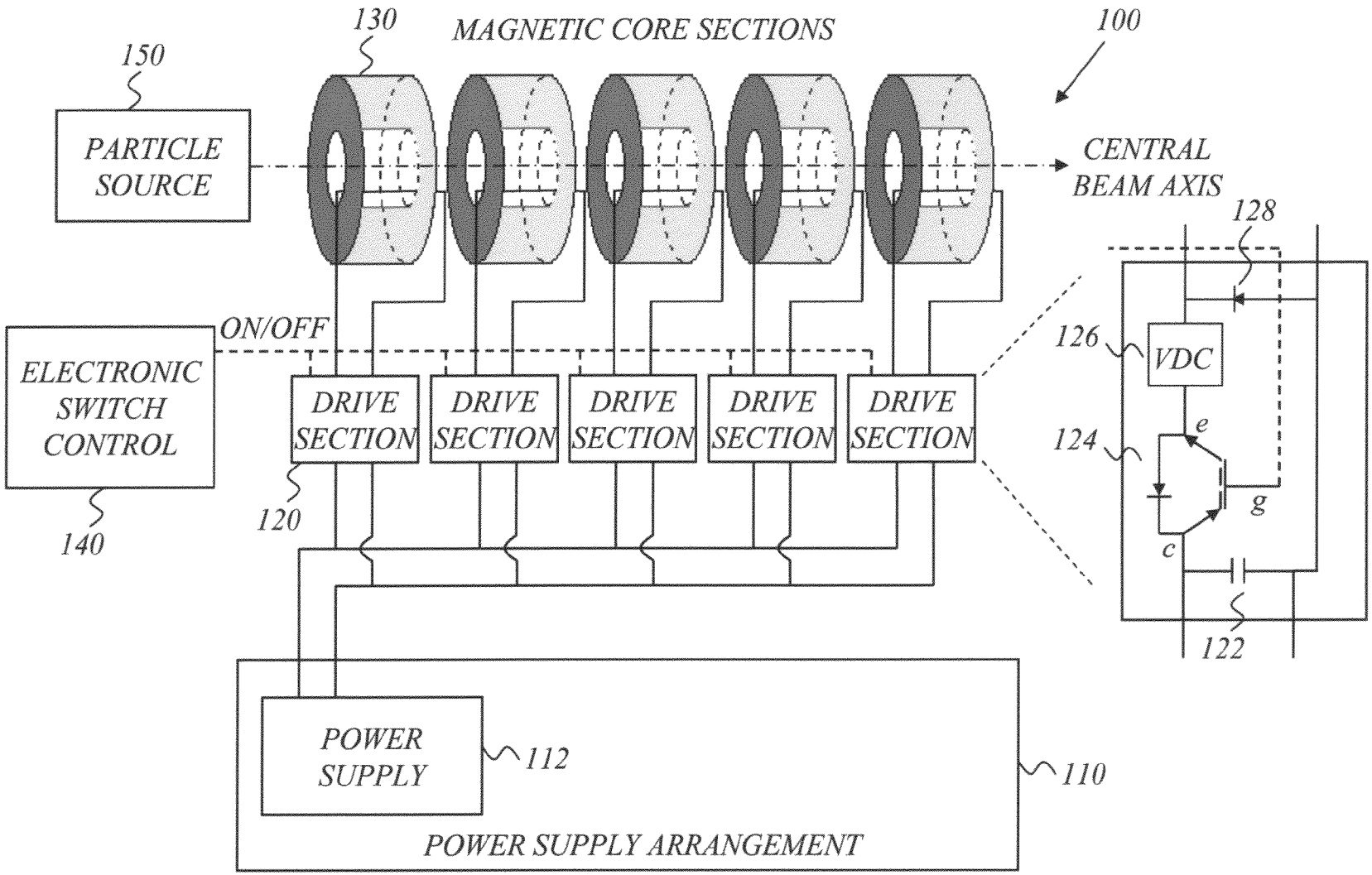
FIG. 4 is a schematic diagram illustrating another specific example of a particle accelerator implementation according to an exemplary embodiment.

FIG. 4 is a schematic diagram illustrating another specific example of a particle accelerator implementation according to an exemplary embodiment. In this example also, each drive section 120 is based on an energy storage capacitor 122 and a solid-state switch 124 in the form of an Insulated-Gate Bipolar Transistor (IGBT). As an optional but beneficial complement, each drive section 120 preferably also includes a voltage-droop compensating (VDC) unit 126 and an optional diode 128 for protecting against voltage spikes, called a despiking or clipper diode.

The voltage-droop compensating (VDC) unit 126 is configured to compensate for a voltage droop, or drop, during discharge of the energy storage capacitor 122, thus controlling the shape of the output pulse so that a pulse of a desired degree of flatness is produced. Preferably, the VDC unit 126 is provided in the form of a passive voltage droop compensating circuit (through which the capacitor energy is transferred), e.g. a parallel resistor-inductor (RL) network circuit.

Figure 5:
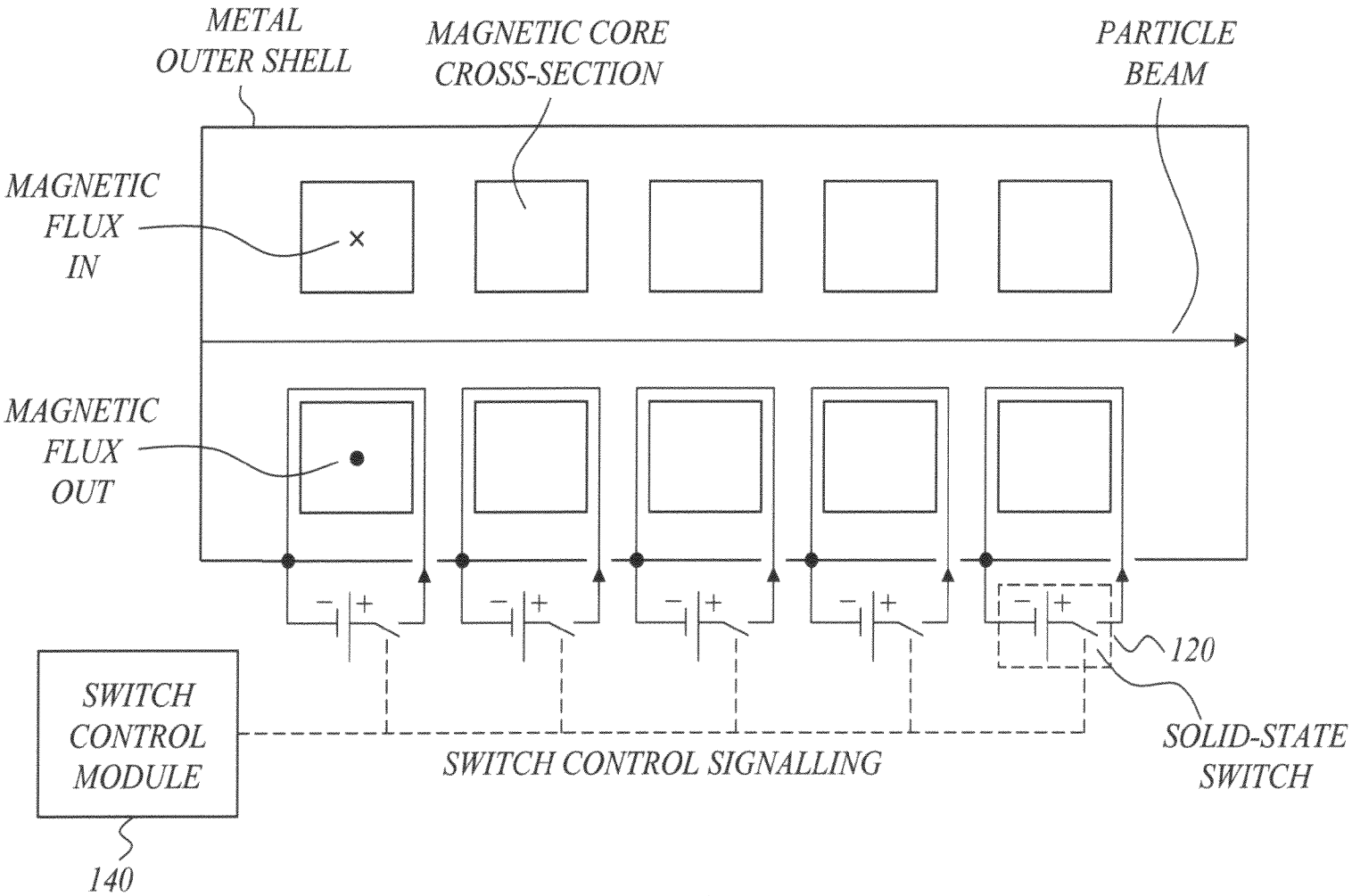
FIG. 5 is a schematic diagram illustrating configuration and operating principles of an induction-based particle accelerator according to an exemplary embodiment.

FIG. 5 is a schematic diagram illustrating configuration and operating principles of an induction-based particle accelerator according to an exemplary embodiment.

For a better understanding, some of the operating principles of a linear induction-based accelerator will now be explained with reference to the simplified schematics of FIG. 5, illustrating a cross-section of an exemplary machine in a plane that includes the beam axis.

Some "rules of the game" are needed to discuss the behavior of the multiple-core accelerator structure shown in FIG. 5. First, the "right-hand rule" is needed. This (arbitrary) rule states that if you grasp a conductor with your right hand, with your thumb pointing in the direction of positive current flow, then your fingers will curl around the conductor in the direction of the magnetic flux lines that encircle the conductor. Applying that rule to FIG. 5, the magnetic flux induced in the toroidal magnetic cores will circulate as shown. A "dot" is used to indicate flux vectors pointing toward the reader (it represents the head of an arrow), and an X is used to represent flux vectors pointing away from the reader (this represents the "feathers" at the back end of the arrow).

Applying this rule to the particle beam flowing toward the right along the axis of the structure, we find that the magnetic flux generated by this beam circulates in the direction opposite to the flux induced by the primary current, which is correct. If we think of this as an imaginary "transformer" and the beam as a "short circuit" across the secondary winding, then the current in this secondary will flow in a direction to cancel the flux induced by the primary, causing no net flux to be induced in the magnetic cores and thus presenting a "short circuit" to the primary power source. No flux change in the cores means no voltage on the primary windings, and this is a short circuit by definition. A beam of positively charged particles (protons) would therefore be accelerated toward the right by the structure, and a beam of negatively charged particles (electrons) would be accelerated toward the left.

We now apply another "rule" of electromagnetic field theory, namely that the voltage induced in a conductor which surrounds a magnetic flux is equal to the rate of change of that magnetic flux (Faraday's Law). Consider a path, which surrounds the flux of all five cores. The voltage induced in an imaginary "wire" that follows this path would equal the rate of change of flux in all of the five cores together. But each core is driven by a primary voltage V, so each core has a rate of change of flux equal to V. Therefore, the voltage induced along the path around all cores would be 5V.

For a more detailed understanding of the conventional operation of a linear induction accelerator in general, reference is made to the basic ASTRON accelerator [1].

Figure 6:
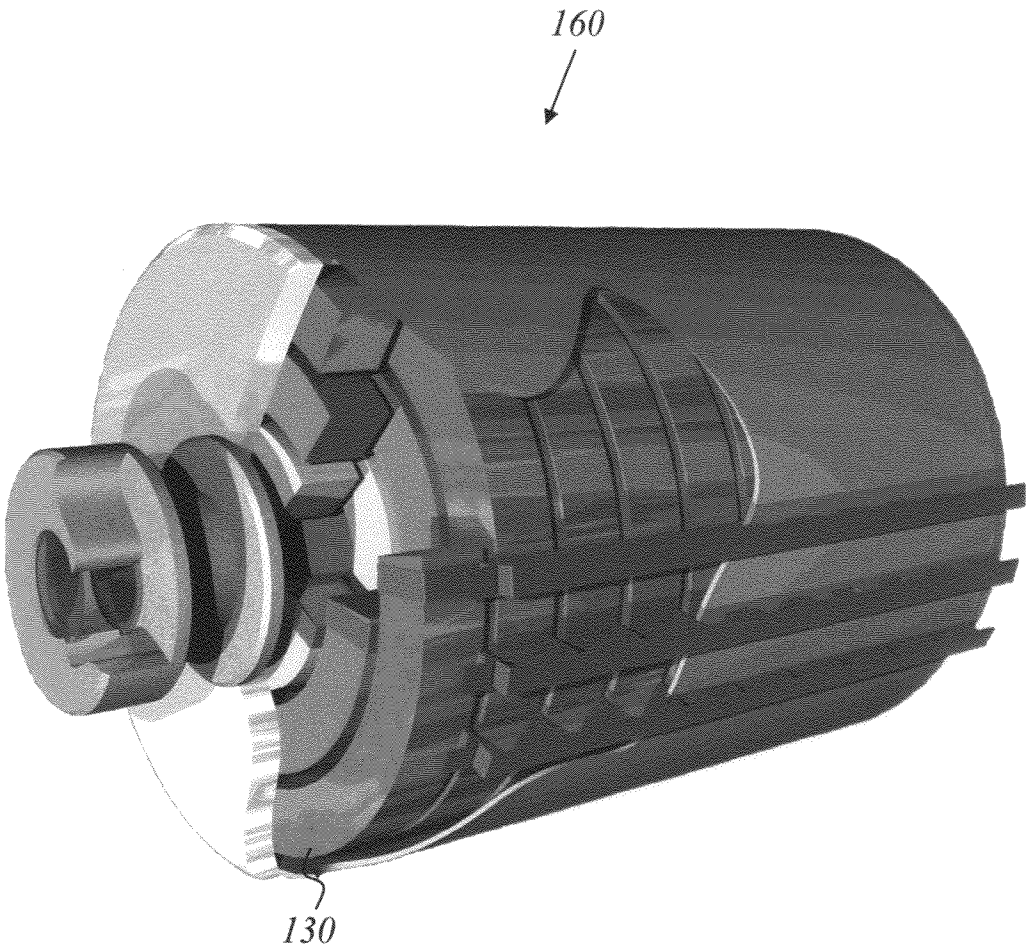
FIG. 6 is a schematic diagram illustrating a basic concept of a novel magnetic core arrangement for a particle accelerator according to an exemplary embodiment.

FIG. 6 is a schematic diagram illustrating an example of a novel magnetic core arrangement for a particle accelerator according to an exemplary embodiment. The magnetic core arrangement 160 basically comprises a plurality of magnetic core sections 130 arranged along a central axis. Each of a number $N \geqq 1$ of the magnetic core sections 130 comprises at least two magnetic cores, a first one of the magnetic cores, referred to as an outer magnetic core, being arranged radially outward from the central axis with respect to a second one of the magnetic cores, referred to as an inner magnetic core. This concept can of course be expanded to several cores per accelerating section, as illustrated in FIG. 6.

By "nesting" one or more additional cores (compared to a single-core section) radially outward from the center, the accelerating E field (Volts/meter of machine length) is raised significantly above a traditional single-core design. This gives the freedom to trade machine diameter against machine length. This in turn allows a much more compact machine, as the machine length can be considerably shortened in comparison to existing designs.

In the example of an accelerating structure of 100 kV, an exemplary number of 100 magnetic cores can be used, where each core is driven by a 1 kV solid-state switched drive pulse. However, by radially nesting magnetic cores so that each magnetic core section includes say for example 5 cores each, only 20 core sections are required, enabling a very compact design.

The novel magnetic core arrangement may be combined with any of the previously disclosed embodiments of FIGS. 2-5, but may alternatively be used together with any suitable electrical drive arrangement in any suitable type of particle accelerator, including linear particle accelerators with or without induction-based acceleration principles for operation. In the following, however, the novel magnetic core arrangement will be described with reference to the particular example of a linear induction-based particle accelerator.

Figure 7:
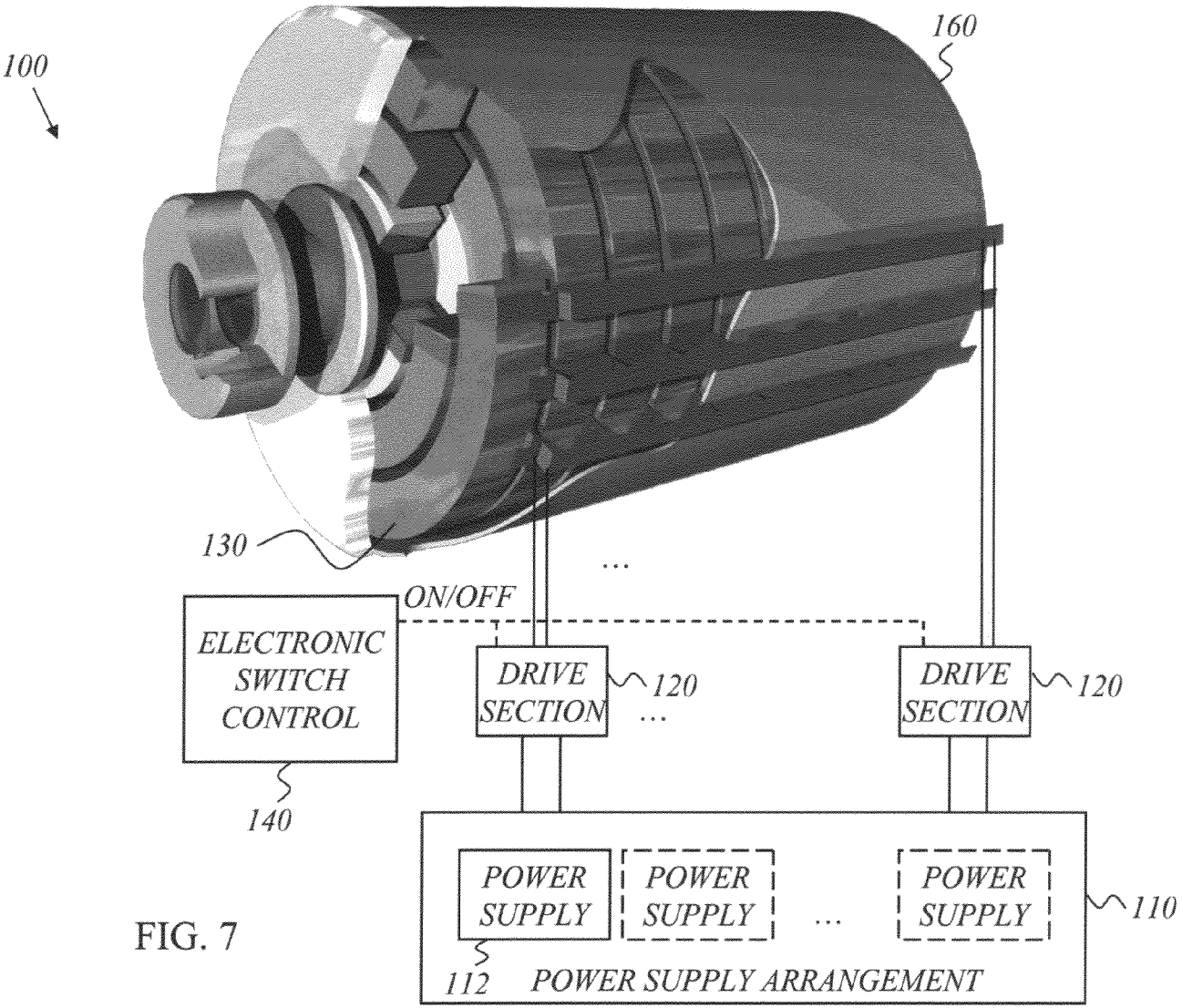
FIG. 7 is a schematic diagram illustrating a novel induction-based particle accelerator equipped with the magnetic core arrangement of FIG. 6.

FIG. 7 is a schematic diagram illustrating a novel induction-based particle accelerator equipped with the magnetic core arrangement of FIG. 6. The accelerator 100 basically comprises a power supply arrangement 110 having one or more power supply units 112, a plurality of solid-state switched drive sections 120, a plurality of magnetic core sections 130, and electronic switch control module 140 and a particle source 150. The magnetic core sections 130 are combined in a novel magnetic core arrangement 160.

The solid-state switched drive sections 120 are connected to the power supply arrangement 110 for receiving electrical power therefrom. Each solid-state switched drive section 120 preferably comprises a solid-state switch, electronically controllable at turn-on and turn-off, for selectively providing a drive pulse at an output of the solid-state switched drive section 120.

The magnetic core sections 130 are symmetrically arranged along the central beam axis. Each of a number $N \geqq 1$ of the magnetic core sections 130 comprises at least two magnetic cores, a first one of the magnetic cores, referred to as an outer magnetic core, being arranged radially outward from the central axis with respect to a second one of the magnetic cores, referred to as an inner magnetic core. This concept can of course be expanded to several cores per accelerating section. Each magnetic core is preferably coupled to a respective one of the solid-state switched drive sections 120 through an electrical winding that is connected to the output of the solid-state switched drive section.

The switch control module 140 is connected to the solid-state switched drive sections 120 for providing control signals (ON/OFF) to control turn-on and turn-off of the solid state switches of the drive sections 120 to selectively drive the magnetic cores of the magnetic core sections 130 in order to induce an electric field for accelerating the beam of charged particles originating from the particle source (not shown in FIG. 7) along the central beam axis of the overall accelerating structure.

In this way, a very compact low-cost induction-based accelerator can be obtained with a high degree of reliability, on-line availability and safety (low-voltage drive).

In comparison to traditional machines, some of the exemplary advantages will be summarized below:

- Traditional machines use high-voltage (10 kV to 100 kV) pulse sources to drive the cores, thereby restricting them to spark gap or thyratron switches, or saturating-core magnetic switches.
- Traditional machines use one power supply per core, an unnecessary restriction as has been pointed out above. Actually, a single power supply source can drive all the cores in the structure if desired, a considerable simplification and cost-saving feature not recognized by the designers of existing machines.
- Because traditional machines use high voltage drive systems, they require either oil or high-pressure gas insulation for the core-driving pulsers; an unnecessary complication which can be avoided.
- Traditional machines all use a single core at each accelerator section. This is also not necessary, and in exemplary embodiments we have expanded the concept to several cores per accelerating section by "nesting" additional cores radially outward from the center, thereby raising the accelerating E field (Volts/meter of machine length) above a single-core design. This gives the freedom to trade machine diameter against machine length. This in turn leads to a more compact machine, as the machine length can be considerably shortened in comparison to existing designs. For example Astron (in the 1969 version) was a 4.2 MeV machine, and was approximately 100 feet (30.5 meters) long. By nesting one or more additional cores radially outward from the center it would certainly be feasible to produce 4.2 MV accelerating voltage in a length of about 5 meters.
- The new accelerator may use toroidal non-gapped Metglas tape-wound cores, which are available at low cost and can be made to any desired size. No complex core-clamping or mounting structures are needed (unlike the segmented C-cores used in pulse transformers).
- Core cooling may be effectuated by forced-air; the small cross-sectional areas of the cores yield a high ratio of surface area to volume, needed for efficient air cooling. No liquids or heat exchangers are needed.
- The entire accelerating structure may be "passive" (no diodes or other semiconductor components are required in the accelerating structure, unlike the Dynamitron or the ICT). This means there are no parts in the accelerator subject to "wear-out" or arc damage or radiation damage. The only limited-life parts are the electron source (hot filament) and beam exit (metal foil) window. These two parts are preferably mounted in extension pipes external to the accelerator, so no disassembly of the accelerator is required to service these parts.
- The accelerator is preferably driven by solid-state drive modules, so again no limited-life components are used. These modules can be located at any convenient point away from the accelerator itself, so radiation damage to the semiconductors is not a concern. Insulated-Gate Bipolar Transistor (IGBT) drive modules are one of many possible drive modules.

The embodiments described above are merely given as examples, and it should be understood that the present invention is not limited thereto. Further modifications, changes and improvements which retain the basic underlying principles disclosed and claimed herein are within the scope of the invention.

REFERENCES

[1] The ASTRON Linear Accelerator, by Beal, Christofilos and Hester, 1969.
[2] Solid-State Technology Meets Collider Challenge, S & TR, September 2004, pp. 22-24.
[3] U.S. Pat. No. 5,905,646
[4] U.S. Pat. No. 6,741,484
[5] US 2003/0128554 A1
[6] WO 2008/051358 A1
[7] WO 2007/120211 A2
[8] WO 2008/033149 A2

The invention claimed is:

1. An induction-based linear particle accelerator for accelerating a beam of charged particles along a central beam axis, said linear particle accelerator having an outer surface at ground potential said linear particle accelerator comprising:

a power supply arrangement;

a plurality of solid-state switched drive sections connected to said power supply arrangement for receiving electrical power from said power supply arrangement, wherein each solid-state switched drive section comprises an energy storage capacitor adapted to be selectively charged by said power supply arrangement, and a solid-state switch, electronically controllable at turn-on and turn-off, for selectively providing a drive pulse at an output of the solid-state switched drive section, said switch being operable to turn-on to start the drive pulse by transferring capacitor energy form the energy-storage capacitor and operable to turn-off to terminated the drive pulse, thereby providing low-voltage drive of the linear particle accelerator;

a plurality of magnetic core sections symmetrically arranged along said central beam axis, wherein each magnetic core of the magnetic core sections is coupled to a respective one of said solid-state switched drive sections through an electrical winding that is connected to said output of the solid-state switched drive section; and a switch control module, connected to said plurality of solid-state switched drive sections, for providing control signals to control turn-on and turn-off of said solid state switches to selectively drive the magnetic core sections to induce an electric field for accelerating said beam of charged particles along said central beam axis.

2. The induction-based linear particle accelerator of claim 1, wherein each magnetic core section comprises at least one toroidal magnetic core.

3. The induction-based linear particle accelerator of claim 1, wherein at least one of said magnetic core sections comprises at least two magnetic cores, a first of said at least two magnetic cores, referred to as an outer magnetic core, being arranged radially outward from the central axis with respect to a second of said at least two magnetic cores, referred to as an inner magnetic core.

4. The induction-based linear particle accelerator of claim 3, wherein each one of said magnetic core sections comprises at least two magnetic cores, a first of said at least two magnetic cores, referred to as an outer magnetic core, being arranged radially outward from the central axis with respect to a second of said at least two magnetic cores, referred to as an inner magnetic core.

5. The induction-based linear particle accelerator of claim 2, wherein said at least one toroidal magnetic core is a non-gapped Metglas tape-wound magnetic core.

6. The induction-based linear particle accelerator of claim 1, wherein said power supply arrangement comprises a connection arrangement enabling connection of a power supply unit to more than one of said solid-state switched drive sections.

7. The induction-based linear particle accelerator of claim 1, wherein at least one of said solid-state switches is an Insulated Gate Bipolar Transistor (IGBT) switch.

8. The induction-based linear particle accelerator of claim 1, wherein said solid-state switched drive sections are solid-state switched pulse generator sections.

9. The induction-based linear particle accelerator of claim 1, wherein each drive section further comprises a voltage-droop compensating unit configured to compensate for a voltage droop during discharge of the energy storage capacitor.

10. The induction-based linear particle accelerator of claim 9, wherein said voltage-droop compensating unit comprises a passive voltage drop compensating circuit through which the capacitor energy is transferred.

11. An induction-based particle accelerator for accelerating a beam of charged particles along a central beam axis, said particle accelerator comprising:

a power supply arrangement;

a plurality of solid-state switched drive sections connected to said power supply arrangement for receiving electrical power from said power supply arrangement, wherein each solid-state switched drive section comprises a solid-state switch, electronically controllable at turn-on and turn-off, for selectively providing a drive pulse at an output of the solid-state switched drive section;

a plurality of magnetic core sections symmetrically arranged along said central beam axis, each magnetic core section comprising at least one toroidal magnetic core, wherein each said toroidal magnetic core of the magnetic core sections is coupled to a respective one of said solid-state switched drive sections through an electrical winding that is connected to said output of the solid-state switched drive section; and a switch control module, connected to said plurality of solid-state switched drive sections, for providing control signals to control turn-on and turn-off of said solid state switches to selectively drive the magnetic core sections to induce an electric field for accelerating said beam of charged particles along said central beam axis.

12. The induction-based particle accelerator of claim 11, wherein the induction-based particle accelerator is an induction-based linear particle accelerator.

13. The induction-based particle accelerator of claim 11, wherein said at least one toroidal magnetic core is a non-gapped Metglas tape-wound magnetic core.

14. A particle accelerator, comprising:

an outer surface configured to be at ground potential;

a power supply arrangement;

a plurality of solid-state switched drive sections connected to said power supply arrangement for receiving electrical power from said power supply arrangement, wherein each solid-state switched drive section comprises an energy storage capacitor and an electronically controllable solid-state switch configured for selectively providing a drive pulse at an output of the solid-state switched drive section, said switch being operable to turn-on to start the drive pulse by transferring capacitor energy from the energy-storage capacitor and operable to turn-off to terminated the drive pulse, thereby providing low-voltage drive of the linear particle accelerator;

a plurality of magnetic core sections symmetrically arranged along said central beam axis, wherein each magnetic core of the magnetic core sections is coupled to a respective one of said solid-state switched drive sections through an electrical winding that is connected to said output of the solid-state switched drive section; and a switch control module, connected to said plurality of solid-state switched drive sections, for providing control signals to control turn-on and turn-off of said solid state switches to selectively drive the magnetic core sections to induce an electric field for accelerating said beam of charged particles along said central beam axis, wherein the particle accelerator is an induction-based linear particle accelerator configured for accelerating a beam of charged particles along a central beam axis.

15. The particle accelerator of claim 14, wherein each magnetic core section comprises at least one toroidal magnetic core.

16. The particle accelerator of claim 14, wherein at least one of said magnetic core sections comprises at least two magnetic cores, a first of said at least two magnetic cores, referred to as an outer magnetic core, being arranged radially outward from the central axis with respect to a second of said at least two magnetic cores, referred to as an inner magnetic core.

17. The particle accelerator of claim 16, wherein each one of said magnetic core sections comprises at least two magnetic cores, a first of said at least two magnetic cores, referred to as an outer magnetic core, being arranged radially outward from the central axis with respect to a second of said at least two magnetic cores, referred to as an inner magnetic core.

18. The particle accelerator of claim 15, wherein said at least one toroidal magnetic core is a non-gapped Metglas tape-wound magnetic core.

19. The particle accelerator of claim 14, wherein said power supply arrangement comprises a connection arrangement enabling connection of a power supply unit to more than one of said solid-state switched drive sections.

* * * * *